US005947184A

United States Patent [19]

Steen et al.

[11] Patent Number: 5,947,184

[45] Date of Patent: Sep. 7, 1999

[54] EQUIPMENT FOR CONTINUOUS CASTING OF METALS

[75] Inventors: Idar Kjetil Steen; Harald Næss, Jr., both of Sunndalsøra; Jan Siversen, Grøa; Sigmund Sandvoll, Øvre Årdal; Leif Aalmo, Sunndalsøra; Bjarne Heggseth, Frei; Arild Håkonsen, Sunndalsøra; Magne Ødegård, Ålvundeid, all of Norway

[73] Assignee: Norsk Hydro Asa, Oslo, Norway

[21] Appl. No.: 08/820,086

[22] Filed: Mar. 19, 1997

[30] Foreign Application Priority Data

Mar. 20, 1996 [NO] Norway ..... 961142

[51] Int. Cl.[6] ..... B22D 11/04

[52] U.S. Cl. ..... 164/435; 164/436; 164/418

[58] Field of Search ..... 164/459, 418, 164/491, 424, 436, 435

[56] References Cited

U.S. PATENT DOCUMENTS

| | | | |
|---|---|---|---|
| 3,717,197 | 2/1973 | Strack et al. | 164/436 |
| 3,933,192 | 1/1976 | Rodenchuk et al. | 164/436 |
| 4,669,526 | 6/1987 | Hury | 154/418 |
| 4,810,191 | 3/1989 | Watson | 432/241 |
| 4,892,134 | 1/1990 | Zuber | 164/436 |
| 5,033,536 | 7/1991 | Keutgen et al. | 164/491 |

*Primary Examiner*—Patrick Ryan
*Assistant Examiner*—Anjan Dey
*Attorney, Agent, or Firm*—Wenderoth, Lind & Ponack, L.L.P.

[57] ABSTRACT

Equipment for continuous casting of strands of metals, preferentially ingots of aluminium. The equipment comprises a flexible casting mould 1 that may be rectangular with two side faces 4, 5 restrained against movement and two flexible side faces 2, 3. The flexible side faces are provided with a stiffening part 36 in their middle regions, that sustains such a rigidity that the shape of the side faces in said regions are substantial constant as the side faces are bowed. The restrained side faces 4, 5 may have a stiffening part that passes lengthwise through the side face and possibly through the adjacent corners. This will have the effect that the flexible faces will behave as rigid affixed in their ends. The stiffening part 36 of the flexible side faces is attached to drag beams 6, 7 in an actuating mechanism 43. The actuating mechanism comprises pull/push bars 14, 15, 16, 17 that via link arms 23, 24, 25, 26 are connected with swingable force transmitting plates 27, 28 swinged by means of an actuator. The actuator may be provided with an external or an internal position sensor, and by means of a PLC program and a servo valve the flexure may be controlled according to a pre-defined scheme of flexure. The outside of the casting mould may suitable be provided with a simplified and improved cooling system comprising a coolant jacket 39, that may be made out of a plastics profile or an aluminium profile attached to the mould wall 42.

27 Claims, 5 Drawing Sheets

EQUIPMENT FOR CONTINUOUS CASTING OF METALS

BACKGROUND OF THE INVENTION

The present invention relates to an equipment for continuous casting of strands of metals, preferably ingots of aluminium, comprising a flexible mould.

The casting of rectangular ingots commonly involves the use of moulds where the widest faces of the mould have a concave curvature. Such curvature is necessary to compensate for the shrinkage in the side surfaces under the casting operation. The amount of shrinkage will be proportional with the extension of the non-frozen metal in the strand after casting conditions are stabilized. During the casting of large ingots, the extension of melted metal in the lengthways direction of the ingot (marsh-depth) may be up to 0.8 meters.

It is primarily the casting speed that influences the extension of the marsh, because it is the thermal conductivity of the material that limits the cooling speed in the middle of the strand. The amount of water that is sprayed onto the surface of the ingot from the underside of the casting mould will represent a cooling capacity that goes beyond the amount of heat that is transported to the surface by heat conduction.

With respect to both metallurgy and productivity, it is desirable to apply the highest casting speed possible. The casting speed is normally limited by the tendency of heat cracks to form in the strand casted when the speed is too high.

In the initial stage of a casting operation the cooling will be slow and there will be a contraction in the strand casted caused by the difference in specific density between the melted and the frozen metal, together with the thermal coefficient of expansion. The metal that has frozen initially will be of a somewhat reduced shape with respect to the geometry of the casting mould. Because of the above mentioned curvature of the widest faces of the casting mould, the strand casted will have a convex shape in the initial stage of the casting operation. The convexity will gradually reduce until stable conditions with respect to the marsh-depth in the strand casted are established. The rolling mills specify that the rolling surfaces should be straight and planar (i.e. without any concavity/convexity in the rolling surfaces). To meet this requirement, the casting moulds have to be designed with an amount of flexing (curvature of the widest faces) that is related to the expected shrinkage/contraction.

The lowest part of the casting strand has a defined convex cross-cut that is commonly recognized as the butt end. The extension of the butt end is mainly determined by the amount of flexing in the respective casting mould. Typically, the extension may vary from 20 centimeters to 80 centimeters depending on the dimensions of the strand casted and the amount of flexing. The part of the butt end that will not satisfy the specifications of the customer has to be cut off by the ingot producer and represents a substantial part of the scrap produced in the casting process.

As mentioned above, it is mainly the casting speed that determines the contraction, and a casting mould will therefore render an optimal ingot geometry for a certain speed. In other words, a casting mould designed for a high casting speed will produce a convex ingot when casting at a lower speed than the design speed. On the other hand, casting speed that is too high with respect to the designed speed will give concave rolling surfaces.

To optimize the return from the casting process and to reduce the geometrical deviations of the strands casted, there have been developed casting moulds with flexible wide faces.

U.S. Pat. No. 4,030,536 discloses a casting mould for continuous casting of ingots of rectangular cross-section. The narrow faces of the ingot are arranged in such a manner that their mutual distance is kept as constant as possible, while the wide faces are flexible. As the casting speed increases, the distance between the middle parts of the wide faces is gradually increased. According to the example disclosed, the distance between the wide faces of the mould is adjusted by means of a flexing mechanism comprising a manually-actuating screw jack device 16 arranged at the outside of each wide face. Each screw jack device is connected at one end with a rigid frame section at the outside of the mould, and connected at the other end by means of a yoke and two hinged connections with the wide face of the mould. This attachment of the yoke will cause the inner surface of the mould to have an even, concave shape as the jack is tensioned. Thus, the maximum value of the distance between the wide surfaces of the mould will be apparent as the distance between the hinged connections at each side. The presented solution further comprises a cooling system that chills the strands as they are casted. The cooling system comprises an upper and a lower channel for coolant water surrounding the mould, at a short distance from the mould, where the channels have orifices that sprays coolant water respectively towards the walls of the mould and the strand casted.

One disadvantage of this embodiment is that it requires an active follow-up by the operators for the control of the mould flexure versus the changes of casting speed, as long as the part rejected should not become too comprehensive. One another disadvantage with this solution is that the even, convex shape of the wide faces contributes to the rejection of at least one first part of the ingot casted because it does not satisfy the required tolerances set by the customer.

SUMMARY OF THE INVENTION

With the equipment according to the present invention, the amount of casting rejected may be reduced to a minimum. This is achieved because the equipment includes an improved casting mould with a flexing mechanism that gives an optimal flexure versus casting speed. At the same time, the equipment is simple in use and demands little space.

According to the first independent claim, the equipment is characterised in that the side faces adapted for flexing are provided with a stiffening part in their middle regions. The stiffening part sustains such a rigidity during the flexing of the side faces that the shape of these faces in these regions is maintained substantially constant.

BRIEF DESCRIPTION OF THE DRAWINGS

The invention shall now be further described with reference to specific embodiments and enclosed drawings, where.

DETAILED DESCRIPTION OF THE INVENTION

Figure 1:
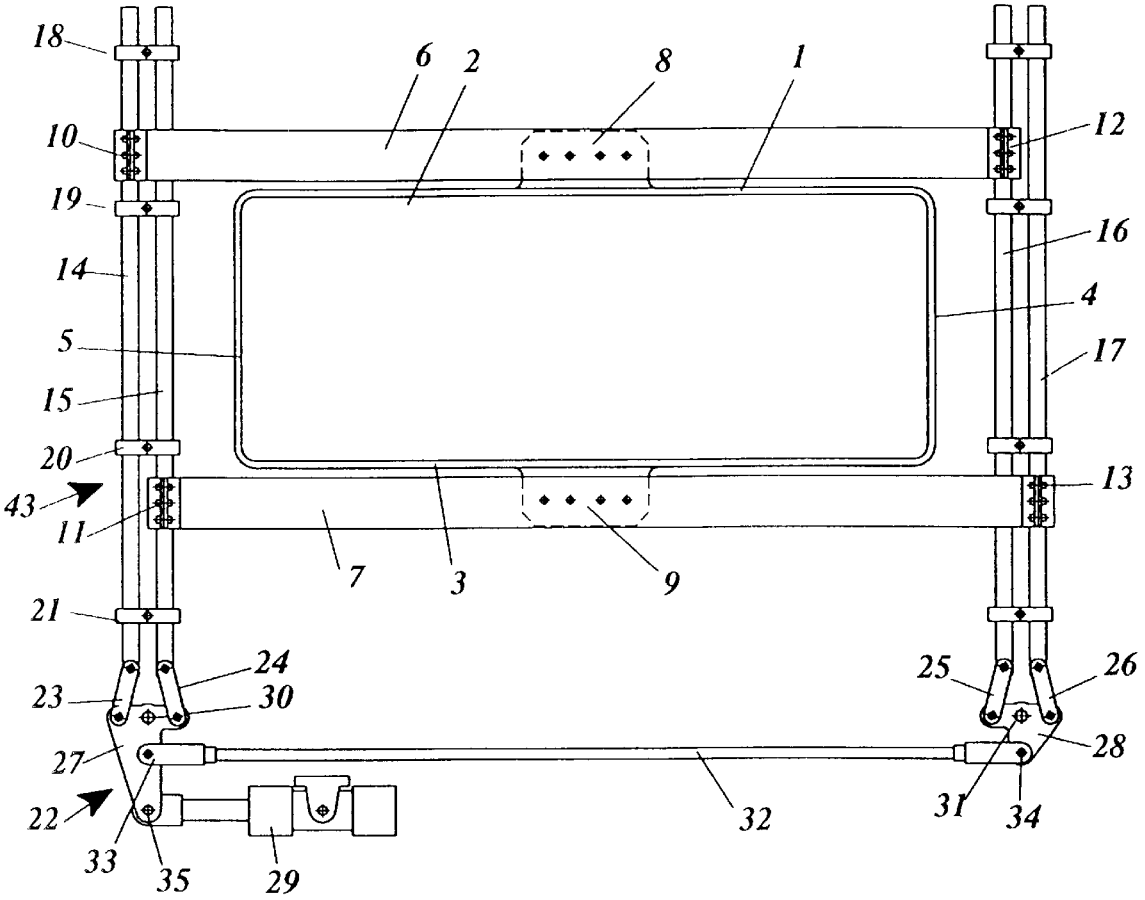
FIG. 1 is a view showing an equipment for continuous casting of metals; comprising a casting mould according to the invention.

FIG. 1 shows a rectangular casting mould 1 with two wide faces 2, 3, and two narrow faces 4, 5. The wide faces 2, 3 are attached at their middle regions to drag beams 6, 7 arranged in parallel with the wide faces of the mould and forming parts of a flexing mechanism 43. The drag beams 6, 7 are of a greater extension than the outer limits of the casting mould 1, and are attached at their ends to pull-/push bars 14, 15, 16, 17 by 1 5 means of friction grip or clamping devices 10, 11, 12, 13. The pull-/push bars are arranged in parallel with the narrow sides of the mould, and are adapted for axial movement by means of slide bearings (left side of the figure) 18, 19, 20, 21 together with an actuating mechanism 22.

The actuating mechanism 22 comprises link arms 23, 24, 25, 26 arranged between the pull-/push bars 14, 15, 16, 17 and swingable force transmitting plates 27, 28 that may be swung by means of an actuator 29 affixed to a stationary frame part (not shown). In the example shown the force transmitting plates 27 and 28 are provided with respective swing axis 30 and 31. The axis are affixed to a stationary frame part (not shown). The force transmitting plate 27 is directly connected with the actuator 29 by means of a link connection 35, while the force transmitting plate 28 is swung by means of a force transmitting rod 32. The rod 32 is provided with link connections 33, 34 at its ends that are further connected with the force transmitting plates 27 and 28.

The transmission ratio of the actuating mechanism is defined by the lever arms between the various link connections and the bearing axis of the force transmitting plates 27 and 28.

The actuator may be a hydraulic piston/cylinder actuator with an internal position sensor. By means of a PLC program, and a servo valve (or proportional valve) the movement of the piston rod may be controlled according to a pre-defined pattern (not further shown). The features make it possible to display a curve representing the flexure (both programmed and real values) on a digital screen forming part of an operator panel.

By controlling the movements of the piston rod it is possible to control the flexing of the mould faces within a narrow interval of tolerances, thus obtaining casted strands of small deviations with respect to nominal geometrical measures. The piston rod may be positioned with a degree of accuracy corresponding to +/−0.2 mm and, when having a transmission ratio corresponding to 4:1 in the actuating mechanism this will correspond to +/−0.05 mm of the mould width.

Figure 2:
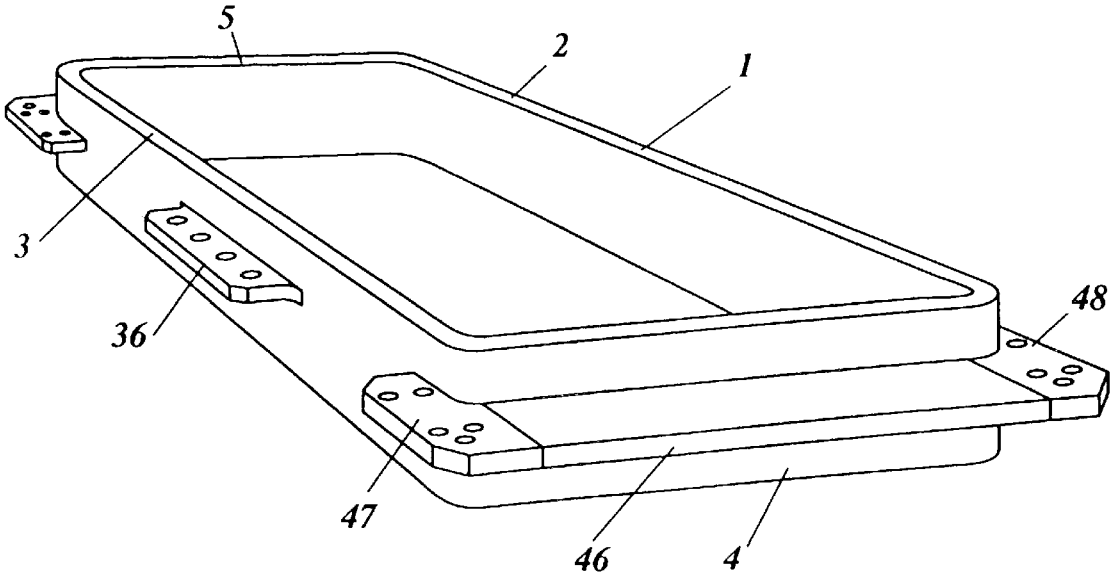
FIG. 2 is a perspective showing the casting mould of FIG. 1.

FIG. 2 shows a casting mould 1 in perspective. The mould may be manufactured out of an aluminium profile that is bent and joined by a weld. Following this operation, the mould may possibly pass through a heat treatment. The profile is T-shaped and the stiffening part is partly removed before bending, but a limited part 36 in the middle region of the wide faces 2, 3 that will serve to stiffen these regions, is maintained. In addition, the stiffening parts in the regions forming the narrow faces 4, 5 of the mould after the bending operation is fulfilled, are maintained too.

The stiffening parts 46 of the narrow faces 4,5 are formed in a manner that they pass through the comers of the mould and possibly they protrude a little into the wide faces of the mould. Thus, these parts of the mould will also be provided with stiffening parts 47, 48. This will result in a limitation of the deformation of the wide faces at their ends, since the mould will behave as rigid at its ends. This is advantageous with respect to the desired deformation of the casting mould, together with a sealed adaptation of a cooling system as described in connection with FIGS. 4 and 5. The extension of the stiffening part 36 will depend on the ratio between the width and the thickness of the casting mould. This will be further described in connection with the description of FIG. 3.

The narrow faces of the casting mould are restricted against movement as they are affixed by bolts to a surrounding, stationary frame (not shown). The wide faces 2, 3 of the mould are affixed to the drag beams 6, 7, by means of the stiffening parts 36. Affixing the wide faces to the drag beams in this manner makes it possible to omit the use of affixing bolts in the mould wall. Further, this affixment serves to provide a reduction in the angular deviation of the mould wall versus the casting direction when the wide faces are flexed. This is achieved since the stiffening parts 36 are affixed to the drag beams by bolts having their length axis in parallel with the direction of casting, thereby obtaining a connection that sustains a high torsional stiffness.

The actuator as described in the present embodiment is of a hydraulic type, but alternatively, pneumatic or electromechanical actuators may be used as well. The reading of the position may alternatively be carried out by a position sensor arranged in connection with one of the force transmitting plates or arranged at another adequate place.

Figure 3:
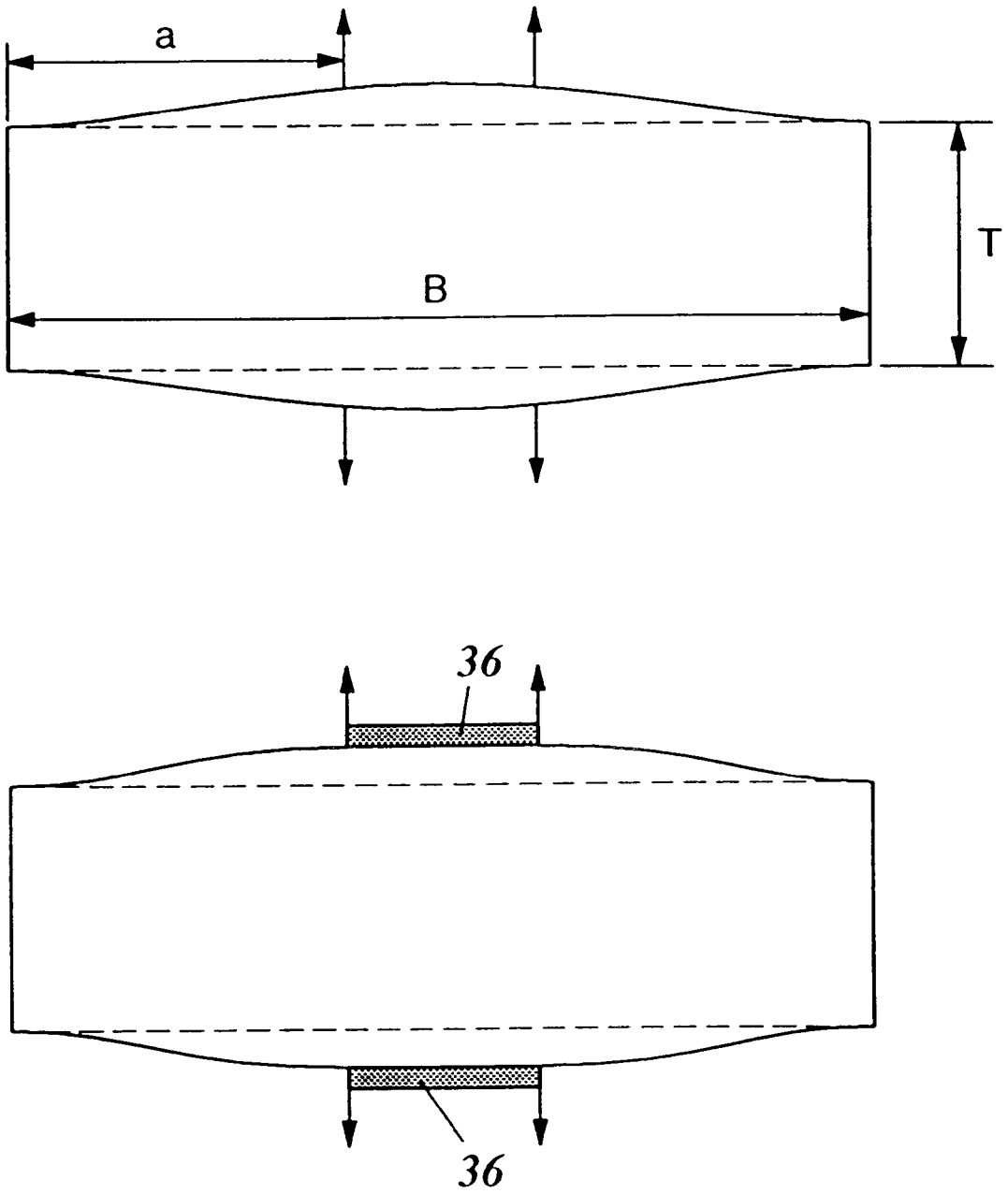
FIG. 3 is a view showing the flexing of a casting mould of known type (upper) and of a casting mould according to the present invention (lower)

FIG. 3 shows the flexure of an upper and a lower casting mould, where the upper represents a known type (as for instance the one described in U.S. Pat No. 4,030,536), and the lower corresponds to the mould according to the present invention.

As seen in the Figure, the wide faces of the mould of the present invention will be planar in the regions of the stiffened middle parts 36 together with their ends, while the mould of known type will sustain an even deformation throughout its wide faces.

Concerning casting moulds having a width/thickness ratio greater than 1.5,a formula is established by computations and experiments that may be applied in the determination of the distance between the narrow sides and the stiffened part 36 of the wide faces:

$$a = B\left[\frac{1.33}{\frac{B}{T}} - \frac{1.27}{\left(\frac{B}{T}\right)^3} - \frac{0.2}{\left(\frac{B}{T}\right)^4}\right]$$

where a corresponds to the distance from the narrow faces to the point where the stiffening part begins, B corresponds to the width of the strand and T corresponds to the thickness of the strand.

The length l of the stiffening part is given by the expression:

$$l = B - 2a \quad \text{or,}$$

$$l = B\left[1 - \frac{2.66}{\frac{B}{T}} - \frac{2.54}{\left(\frac{B}{T}\right)^3} - \frac{0.4}{\left(\frac{B}{T}\right)^4}\right]$$

The optimum value of a appears to be primarily independent with respect to casting parameters and type of alloy.

Figure 4:
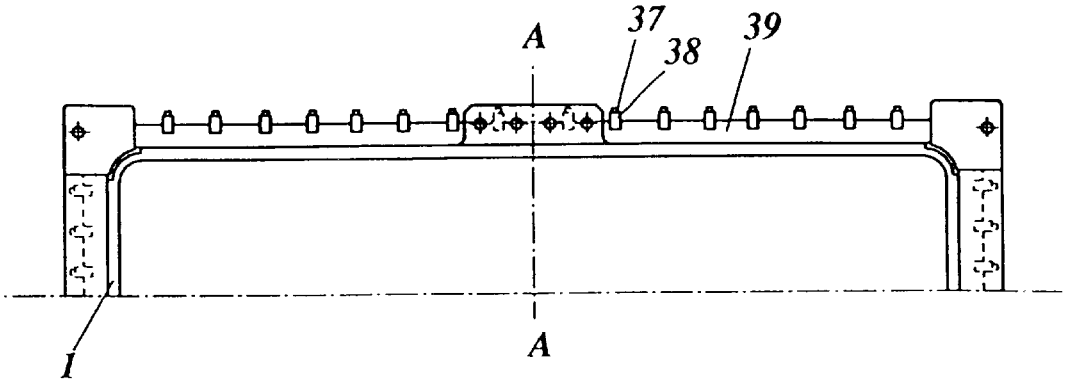
FIG. 4 is a view showing one semi-part of the casting mould of FIG. 1 having a coolant jacket affixed thereto.
Figure 5:
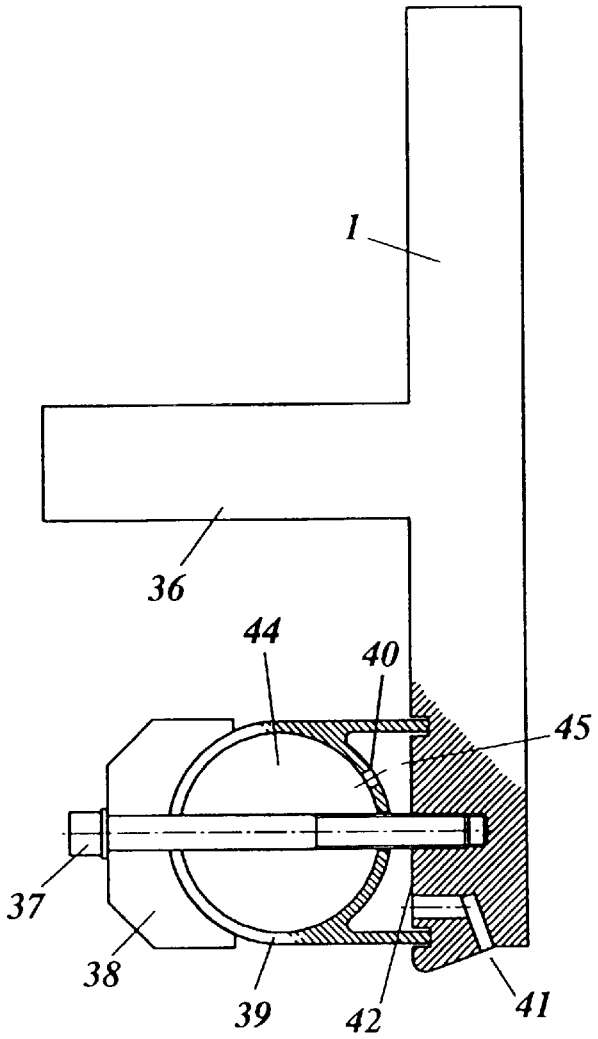
FIG. 5 is a section view showing a cut A—A through the casting mould as shown in FIG. 4.

The affixation of the flexing means, together with the deformation of the mould walls according to the invention, make possible the adaptation of a simplified and improved cooling system, as shown in FIGS. 4 and 5.

FIG. 4 shows a semi-part of the casting mould 1 as shown in FIG. 1, where the mould has attached a coolant jacket 39 thereto. FIG. 5 shows a cut A—A through the casting mould 1 as shown in FIG. 4. The coolant jacket 39 as shown in the Figures is made out of a profile of a material having little resistance to bending, such as plastics or aluminium, and is attached to the mould wall 42 by means of bolts 37 and clamps 38. The fact that the casting mould is made out of a T-shaped profile as mentioned above, render possible the attachment of the coolant jacket below the stiffening parts 36, 46, 47 of the mould, and further that the jacket is well adapted to follow the deformations of the mould.

The coolant jacket has a channel 44 for the transport of water at the outside of the mould. The channel 44 may in a reasonable manner be connected with a supply of coolant water (not shown). From the channel 44 coolant water is led through a plurality of small openings to a second channel 45 that is formed by the coolant jacket 39 and the mould wall 42, and that serves as a primary cooling of the mould wall. Coolant water is led from the channel 45 through bores 41 drilled through the mould wall 42 in such a manner that water is sprayed onto the strand casted (not shown) at an angle of approximately 20 degrees.

Figure 6:
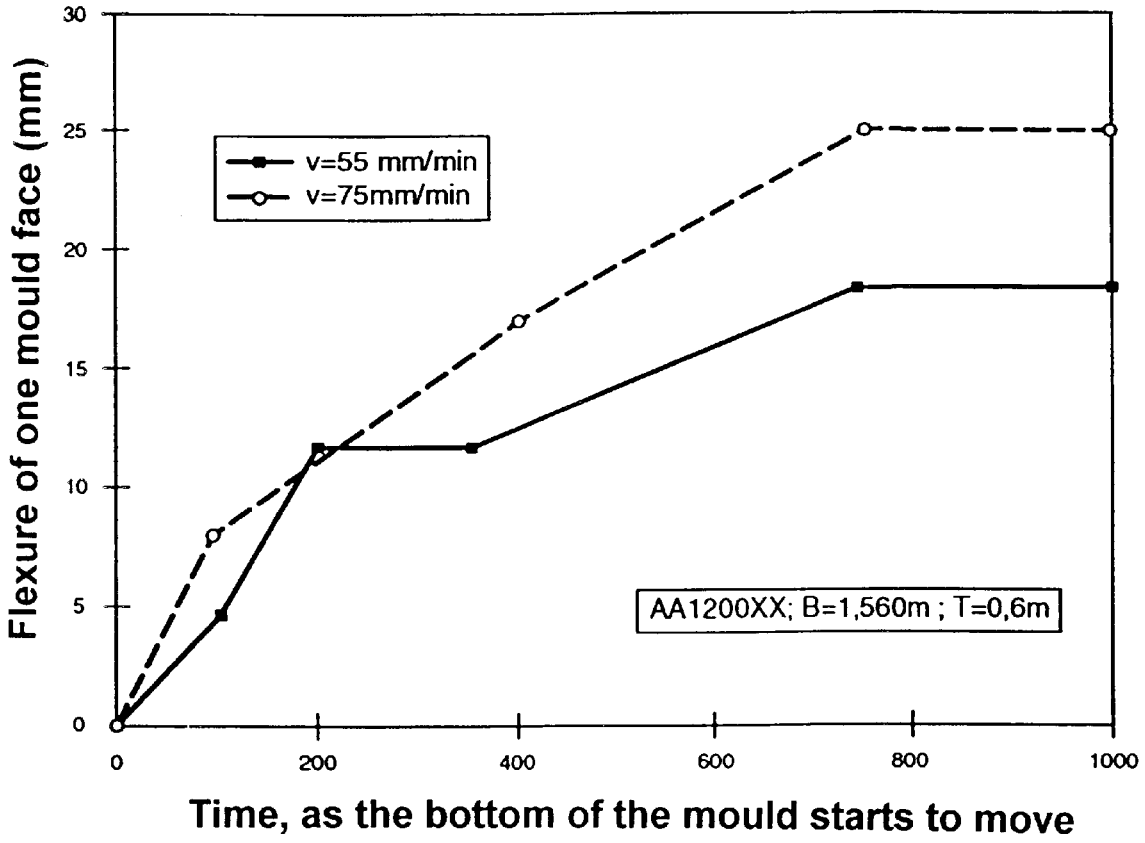
FIG. 6 is a graph showing the flexure of a mould according to the present invention; and at two different casting speeds (v).

FIG. 6 shows the flexure at two different casting speeds, as the alloy casted were quite identical. In this case, a casting mould having a width of 1.56 meters and a thickness of 0.6 meters was applied. The horizontal axis represents the time after the bottom of the casting mould (casting shoe) starts to move, while the vertical axis represents the flexure of one mould face in millimeters. The dotted curve represents a casting speed of 75 mm/minute, while the fully drawn curve represents a speed of 55 mm/minute. As will be seen in the Figure, the final flexure (the stationary flexure) is largest for the case involving the highest casting speed.

The PLC program controlling the flexure may be run on the basis of theoretical/empirical values that are established for the different types of alloys, width-/thickness ratio of casting moulds, and casting speeds.

Experiments that were carried out with a casting equipment according to the present invention, involving casting strands of different alloys at different casting conditions and flexures, have shown that it is now possible to obtain substantial reductions of the parts rejected. In addition, the flexure of the mould now may easily be adjusted in accordance with the casting speeds required for the different alloys.

We claim:

1. An apparatus for continuous casting of strands of metal, comprising:

a casting mould having a first pair of side faces restrained against movement and a second pair of side faces adapted for flexing by a flexing mechanism, each of said second pair of side faces including a middle region having a specified shape; and each of said second pair of side faces including a stiffening part in said middle region, wherein said stiffening part sustains rigidity of each of said second pair of side faces during flexing such that said specified shape of said middle region is maintained substantially constant.

2. The apparatus of claim 1, wherein said stiffening part of each of said second pair of side faces has a length l, said second pair of side faces has a length β, and said first pair of side faces has a length T, wherein when said casting mould has a ratio of length β to length T greater than 1.5, the length l of each of said stiffening parts of each of said second pair of side faces can be determined according to the following formula:

$$l = B\left[1 - \frac{2.66}{\frac{B}{T}} - \frac{2.54}{\left(\frac{B}{T}\right)^3} - \frac{0.4}{\left(\frac{B}{T}\right)^4}\right].$$

3. The apparatus of claim 2, wherein each of said first pair of side faces includes a stiffening part and adjacent corners, said stiffening part of each of said first pair of side faces passing lengthwise along each of said first pair of side faces.

4. The apparatus of claim 2, wherein said casting mould has a T-shaped profile, said casting mould being formed by bending and welding said profile, said T-shaped profile being modified such that a stiffening part remains only in said middle region of each of said second pair of side faces and along each of said first pair of side faces.

5. The apparatus of claim 2, further comprising drag beams intended to form part of the flexing mechanism, each of said second pair of side faces being affixed by said stiffening part of each of said second pair of side faces to said drag beams.

6. The apparatus of claim 2, further comprising mould walls of said casting mould and a cooling system including a coolant jacket ached to an exterior portion of said mould walls.

7. The apparatus of claim 1, wherein said casting mould has a T-shaped profile, said casting mould being formed by bending and welding said profile, said T-shaped profile being modified such that a stiffening part remains only in said middle region of each of said second pair of side faces and along each of said first pair of side faces.

8. The apparatus of claim 7, further comprising drag beams intended to form part of the flexing mechanism, each of said second pair of side faces being affixed by said stiffening part of each of said second pair of side faces to said drag beams.

9. The apparatus of claim 7, further comprising mould walls of said casting mould and a cooling system including a coolant jacket attached to an exterior portion of said mould walls.

10. The apparatus of claim 1, further comprising drag beams intended to form part of the flexing mechanism, each of said second pair of side faces being affixed by said stiffening part of each of said second pair of side faces to said drag beams.

11. The apparatus of claim 10, further comprising mould walls of said casting mould and a cooling system including a coolant jacket attached to an exterior portion of said mould walls.

12. The at of claim 10, further comprising push/pull bars attached to said drag beams, and an actuating mechanism for moving said push/pull bars axially.

13. The apparatus of claim 12, further comprising mould walls of said casting mould and a cooling system including a coolant jacket attached to an exterior portion of said mould walls.

14. The apparatus of claim 12, further comprising an actuator, said actuating mechanism including swingable force transmitting plates connected to said push/pull bars by link arms and capable of being swung by said actuator.

15. The apparatus of claim 14, further comprising mould walls of said casting mould and a cooling system including a coolant jacket attached to an exterior portion of said mould walls.

16. The apparatus of claim 14, wherein said actuator includes a position sensor and a PLC program for controlling said actuator according to a pre-defined scheme for flexure of said second pair of side faces.

17. The apparatus of claim 16, wherein said actuator is hydraulic and controlled by a servo valve.

18. The apparatus of claim 16, further comprising mould walls of said casting mould and a cooling system including a coolant jacket attached to an exterior portion of said mould walls.

19. The apparatus of claim 1, further comprising mould walls of said casting mould and a cooling system including a coolant jacket attached to an exterior portion of said mould walls.

20. The apparatus of claim 19, wherein said coolant jacket is formed of a material having minimal resistance to bending.

21. The apparatus of claim 20, wherein said material is selected from the group consisting of plastic and aluminum.

22. The apparatus of claim 19, wherein said coolant jacket includes a first channel for transportation and distribution of coolant around said casting mould, and a second channel defined by said coolant jacket and said mould walls, said second channel communicating with said first channel through a plurality of openings such that coolant is led from said first channel to said second channel and from said second channel to a by bores arranged in said mould walls.

23. The apparatus of claim 1, wherein each of said first pair of side faces includes a stiffening part and adjacent comers, said stiffening part of each of said first pair of side faces passing lengthwise along each of said first pair of side faces.

24. The apparatus of claim 23, further comprising mould walls of said casting mould and a cooling system including a coolant jacket attached to an exterior portion of said mould walls.

25. The apparatus of claim 23, further comprising drag beams intended to form part of the flexing mechanism, each of said second pair of side faces being affixed by said stiffening part of each of said second pair of side faces to said drag beams.

26. The apparatus of claim 23, wherein said casting mould has a T-shaped profile, said casting mould being formed by bending and welding said profile, said T-shaped profile being modified such that a stiffening part remains only in said middle region of each of said second pair of side faces and along each of said first pair of side faces.

27. The apparatus of claim 23, wherein said stiffening part of each of said first pair of side faces further passes around each of said adjacent corners.

* * * * *